US007058986B2

(12) United States Patent
Pietzyk-Hardy

(10) Patent No.: US 7,058,986 B2
(45) Date of Patent: Jun. 13, 2006

(54) SOCKS WITH SNAP FASTENERS

(76) Inventor: Beverly Pietzyk-Hardy, 24056 Roman Nose Dr., Conifer, CO (US) 80433

( * ) Notice: Subject to any disclaimer, the term of this patent is extended or adjusted under 35 U.S.C. 154(b) by 0 days.

(21) Appl. No.: 11/105,999

(22) Filed: Apr. 14, 2005

(65) Prior Publication Data

US 2005/0262615 A1 Dec. 1, 2005

Related U.S. Application Data

(60) Provisional application No. 60/574,027, filed on May 25, 2004.

(51) Int. Cl.
*A43B 17/00* (2006.01)

(52) U.S. Cl. ..... 2/239; 24/DIG. 29

(58) Field of Classification Search ..... 2/239–242, 2/244; 24/DIG. 29, 3.1, 40, 41.1, 102 FC, 24/904

See application file for complete search history.

(56) References Cited

U.S. PATENT DOCUMENTS

| | | | | | |
|---|---|---|---|---|---|
| 338,341 | A | * | 3/1886 | Dodge | 66/188 |
| 1,037,669 | A | * | 9/1912 | Scott | 66/173 |
| 1,079,268 | A | * | 11/1913 | Scott | 66/173 |
| 1,087,690 | A | * | 2/1914 | Scott et al. | 66/173 |
| 2,187,296 | A | * | 1/1940 | Appel | 24/692 |
| 2,663,877 | A | | 12/1953 | Bohman | |
| 2,710,409 | A | | 6/1955 | Burandt | |
| 3,414,944 | A | | 12/1968 | Rabinowitz | |
| 3,699,617 | A | | 10/1972 | Hofmeister | |
| 4,058,853 | A | | 11/1977 | Boxer et al. | |
| 4,344,240 | A | * | 8/1982 | Schiller | 40/662 |
| 4,373,215 | A | * | 2/1983 | Guigley | 2/239 |
| 4,961,235 | A | * | 10/1990 | Williger | 2/239 |
| 4,975,986 | A | | 12/1990 | Strongwater | |
| 5,038,413 | A | | 8/1991 | Ursino | |
| 5,308,671 | A | * | 5/1994 | Wells | 428/99 |
| 5,321,855 | A | | 6/1994 | Ciuffo | |
| 5,357,660 | A | * | 10/1994 | Smith | 24/662 |
| 5,367,809 | A | | 11/1994 | Ross | |
| 5,450,658 | A | | 9/1995 | Hicks | |
| 5,467,510 | A | * | 11/1995 | Hartzell | 24/706.9 |
| 5,490,309 | A | * | 2/1996 | Velasquez et al. | 24/90.1 |
| 5,509,282 | A | * | 4/1996 | Ferrell, Jr. | 66/188 |
| 5,579,541 | A | | 12/1996 | Christy et al. | |
| 5,699,557 | A | * | 12/1997 | Johnson | 2/239 |
| 5,740,558 | A | | 4/1998 | Messman | |
| 5,918,318 | A | | 7/1999 | Jones | |
| 5,926,925 | A | * | 7/1999 | Hicks | 24/303 |
| 5,956,769 | A | * | 9/1999 | Stepney | 2/129 |
| 5,970,524 | A | | 10/1999 | Becker et al. | |
| 5,974,590 | A | | 11/1999 | Stubbs | |
| 6,032,294 | A | * | 3/2000 | Dean | 2/239 |
| 6,092,241 | A | * | 7/2000 | Bellet | 2/239 |
| 6,108,820 | A | * | 8/2000 | Bernhardt | 2/239 |
| 6,185,751 | B1 | | 2/2001 | Mason | |
| 6,216,279 | B1 | * | 4/2001 | Ellingson | 2/239 |
| 6,237,158 | B1 | * | 5/2001 | Barbara | 2/239 |
| 6,279,169 | B1 | * | 8/2001 | Reichle | 2/239 |
| 6,318,283 | B1 | * | 11/2001 | Coulthard, Jr. | 112/475.12 |
| 2001/0018775 | A1 | * | 9/2001 | Jossi | 2/239 |
| 2002/0029405 | A1 | * | 3/2002 | Outwater | 2/239 |

* cited by examiner

*Primary Examiner*—Alissa L. Hoey
(74) *Attorney, Agent, or Firm*—Dorr, Carson & Birney, P.C.

(57) ABSTRACT

A sock has a cuff with an inner fabric layer and an outer fabric layer folded over at least a portion of the inner fabric layer. A snap fastener is secured to the inner fabric layer. A slit or opening extends through the outer fabric layer to expose the snap fastener so that it can removably engage a complementary snap fastener on a second sock.

5 Claims, 3 Drawing Sheets

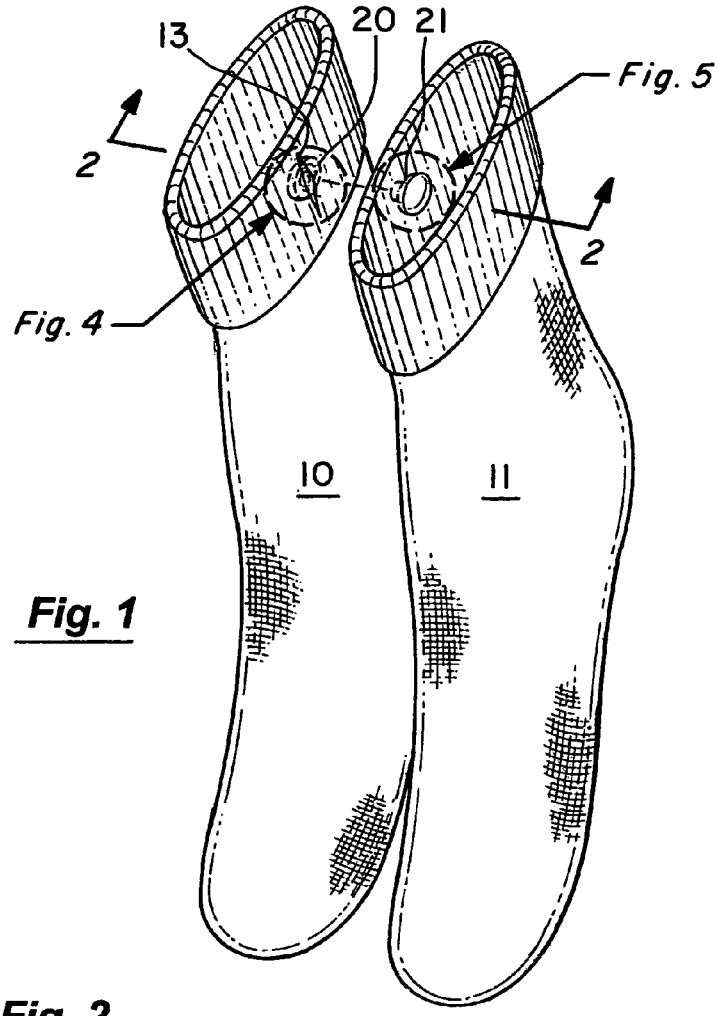
Fig. 1
Fig. 2
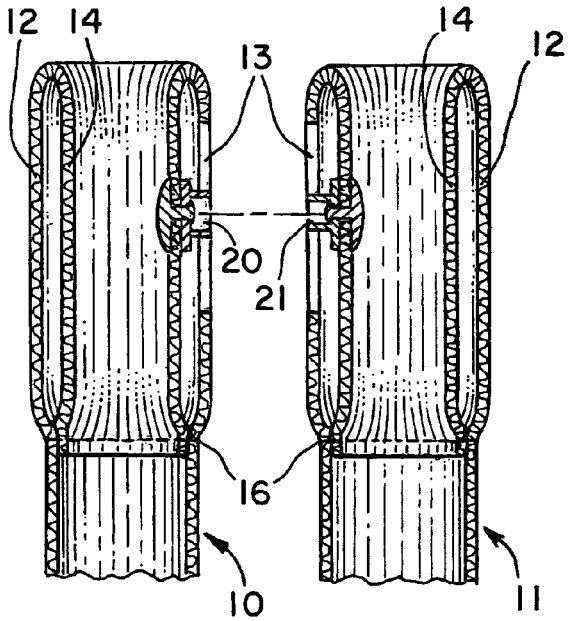
Fig. 3
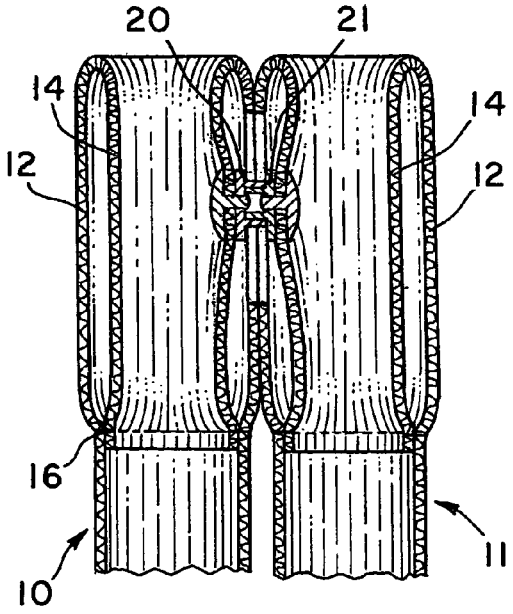

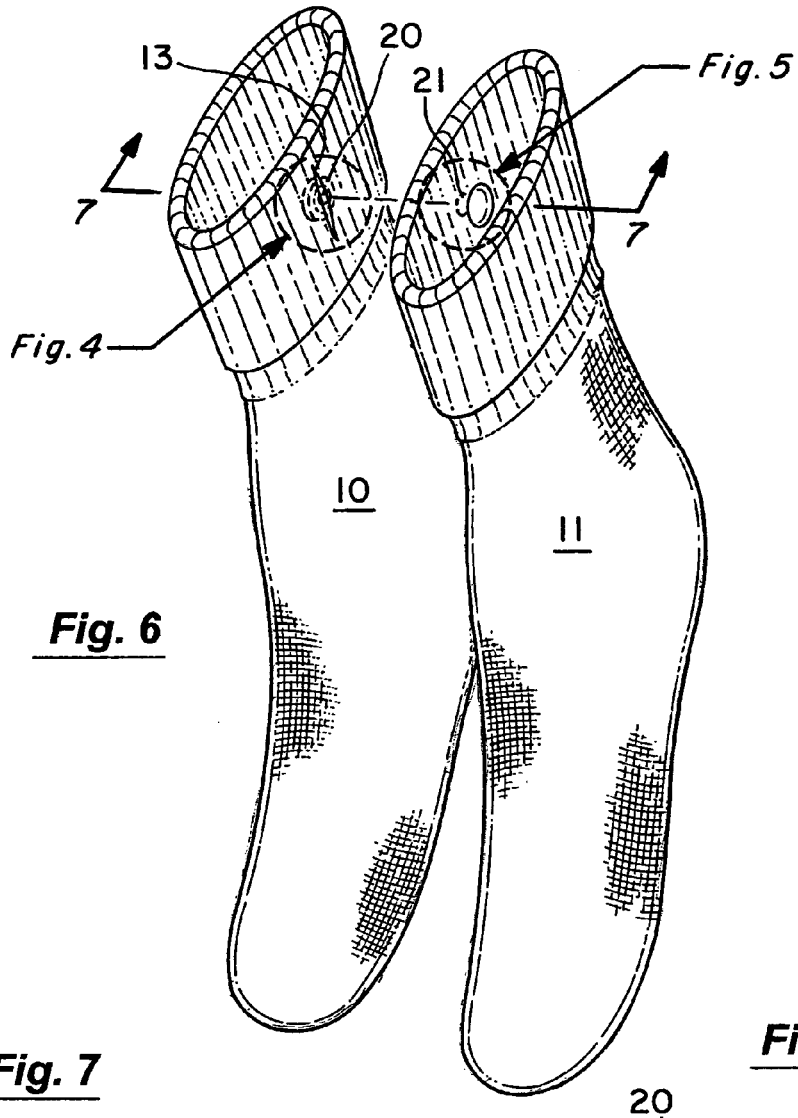
Fig. 6
Fig. 7
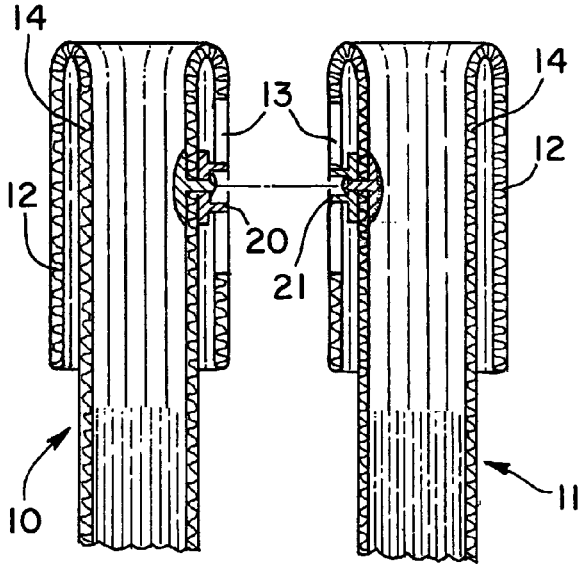
Fig. 8
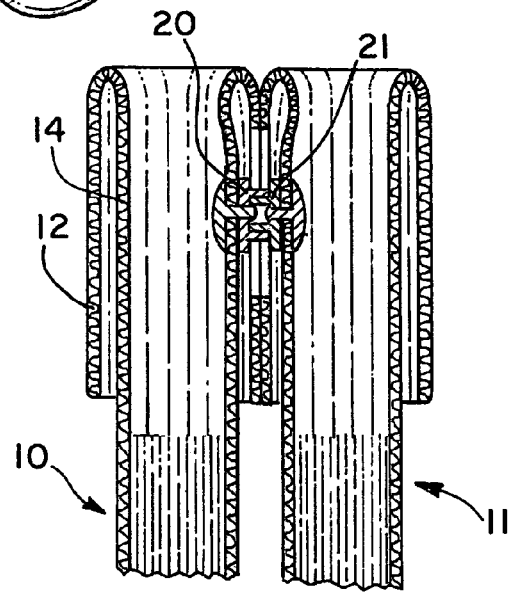

SOCKS WITH SNAP FASTENERS

RELATED APPLICATION

The present application is based on, and claims priority to the Applicant's U.S. Provisional Patent Application Ser. No. 60/574,027, entitled "Socks with Snap Fasteners," filed on May 25, 2004.

BACKGROUND OF THE INVENTION

1. Field of the Invention

The present invention relates generally to the field of fasteners for apparel. More specifically, the present invention discloses socks with snap fasteners to releasably engage a pair of socks to one another.

2. Statement of the Problem

Socks are normally purchased, stored, worn, and laundered in pairs. However, keeping socks in pairs is one of life's little hassles. Therefore, the need exists for a means of keeping pairs of socks together in the laundry or in storage.

The prior art in this field includes the following:

| Inventor | Patent No. | Issue Date |
|---|---|---|
| Bohman | 2,663,877 | Dec. 29, 1953 |
| Burandt | 2,710,409 | Jun. 14, 1955 |
| Rabinowitz | 3,414,944 | Dec. 10, 1968 |
| Hofmeister | 3,699,617 | Oct. 24, 1972 |
| Boxer et al. | 4,058,853 | Nov. 22, 1977 |
| Strongwater | 4,975,986 | Dec. 11, 1990 |
| Ursino | 5,038,413 | Aug. 13, 1991 |
| Ciuffo | 5,321,855 | Jun. 21, 1994 |
| Ross | 5,367,809 | Nov. 29, 1994 |
| Hicks | 5,450,658 | Sep. 19, 1995 |
| Christy et al. | 5,579,541 | Dec. 3, 1996 |
| Messman | 5,740,558 | Apr. 21, 1998 |
| Jones | 5,918,318 | Jul. 6, 1999 |
| Becker et al. | 5,970,524 | Oct. 26, 1999 |
| Stubbs | 5,974,590 | Nov. 2, 1999 |
| Mason | 6,185,751 | Feb. 13, 2001 |

Mason discloses releasably engagable socks in which the cuff of each sock is equipped with a male and a female snap fastener. These snap fasteners can be used to engage complementary snap fasteners on a second sock. Alternatively, the male and female snap fasteners on one sock can be fastened together when the cuff is folded over on itself, to thereby conceal the fasteners from view.

Ursino, Messman, Bohman, Stubbs, Hofmeister and Becker et al. disclose a variety of snap fasteners for removably securing a pair of socks together. Burandt and Strongwater disclose snap fasteners to removably secure a pair of gloves together. Hicks discloses magnetic fasteners to removably secure a pair of socks together. Christy et al., Boxer et al., Ciuffo, and Jones disclose a variety of hook-and-loop fasteners for removably securing a pair of socks together. However, in each case, the fastener or some sort of cover remains visible when the socks are being worn.

Ross discloses an identification tag to be affixed to laundry items, such as socks. Rabinowitz discloses a clip for matching pairs of socks.

3. Solution to the Problem

In contrast to the prior art, the present invention employs a snap fastener on each sock that is largely covered by the sock cuff. A small slit or opening in the outer layer of the sock cuff allows the snap fastener to be exposed so that it can be connected to a complementary snap fastener on a second sock. The snap fasteners keep the socks together while they are in the laundry or storage.

The snap fasteners can be easily separated prior to wearing the socks. The small slit in the sock cuff will then tend to close and largely conceal the snap fastener beneath the outer layer of the sock cuff. This enhances the aesthetic appeal of the present invention while the socks are being worn.

SUMMARY OF THE INVENTION

This invention provides socks with snap fasteners. The cuff of each sock has an inner and an outer layer of fabric. A snap fastener is secured to the inner of the cuff. A small slit or opening extends through the outer layer of the cuff in front of the snap fastener. The head of the snap fastener can be exposed through the slit, so that it can engage a complementary snap fastener on a second sock.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 1 is a perspective view of two socks 10, 11 implementing the present invention.

FIG. 2 is a cross-sectional view of the upper portions of the socks 10, 11 with the snap fasteners 20 and 21 disconnected from one another:

FIG. 3 is a cross-sectional view of the upper portions of the socks 10, 11 with the snap fasteners 20 and 21 connected to one another.

FIG. 6 is a perspective view of two socks 10, 11 in another embodiment of the present invention without a seam at the bottom of the cuff.

FIG. 7 is a cross-sectional view of the upper portion of two socks 1corresponding to FIG. 6 with the snap fasteners 20 and 21 disconnected from one another.

FIG. 8 is a cross-sectional view corresponding to FIG. 7 with the snap fasteners 20 and 21 fastened together.

DETAILED DESCRIPTION OF THE INVENTION

Figure 4:
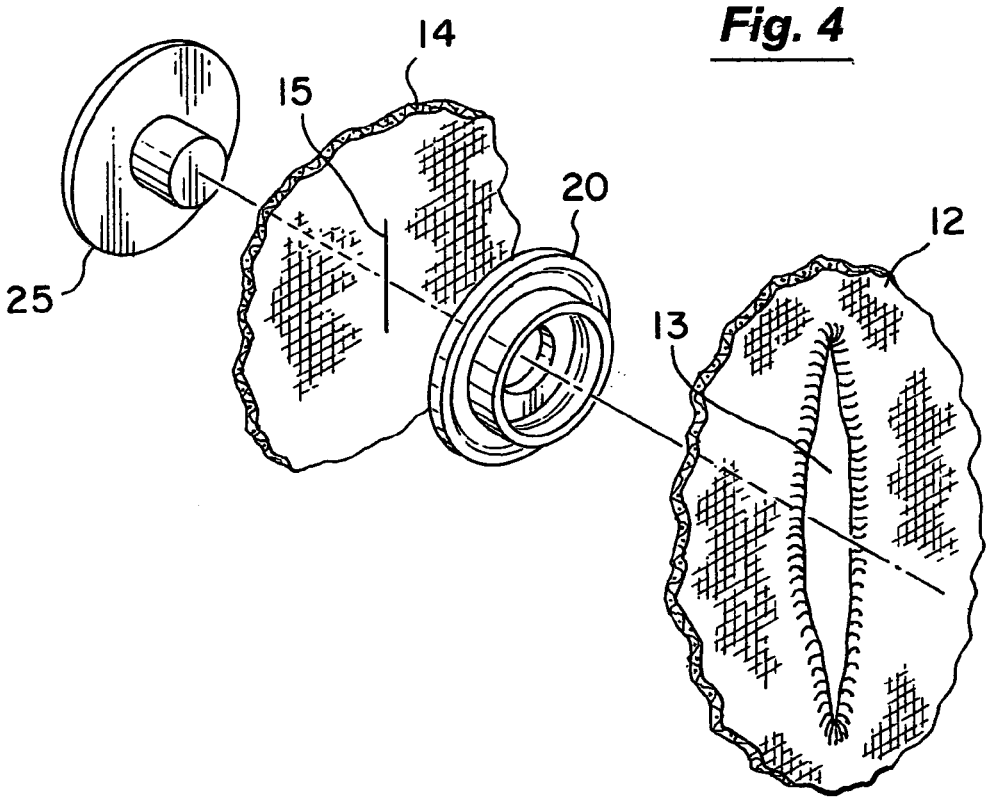
FIG. 4 is a detail exploded perspective view showing the assembly of the female snap fastener and the cuff of the sock.

Turning to FIG. 1, a perspective view is provided showing two socks 10, 11 implementing the present invention. Each sock 10, 11 has a cuff made of an outer fabric layer 12 and an inner fabric layer 14. For example, the cuff can be formed by folding the upper tubular end of the sock downward over itself. Optionally, the outer and inner fabric layers 12, 14 can be sown together at the bottom of the cuff to form a seam 16, as illustrated in the cross-sectional view shown in FIG. 2.

The cuff of each sock 10, 11 is equipped with at least one snap fastener 20, 21 to enable a pair of socks to be releasably engaged to one another. In the embodiments shown in the accompanying drawings, one sock 10 in each pair is provided with a female snap fastener 20, while the other sock 11 is provided with a complementary male snap fastener 21 that can removably engage the female snap fastener 20.

Figure 5:
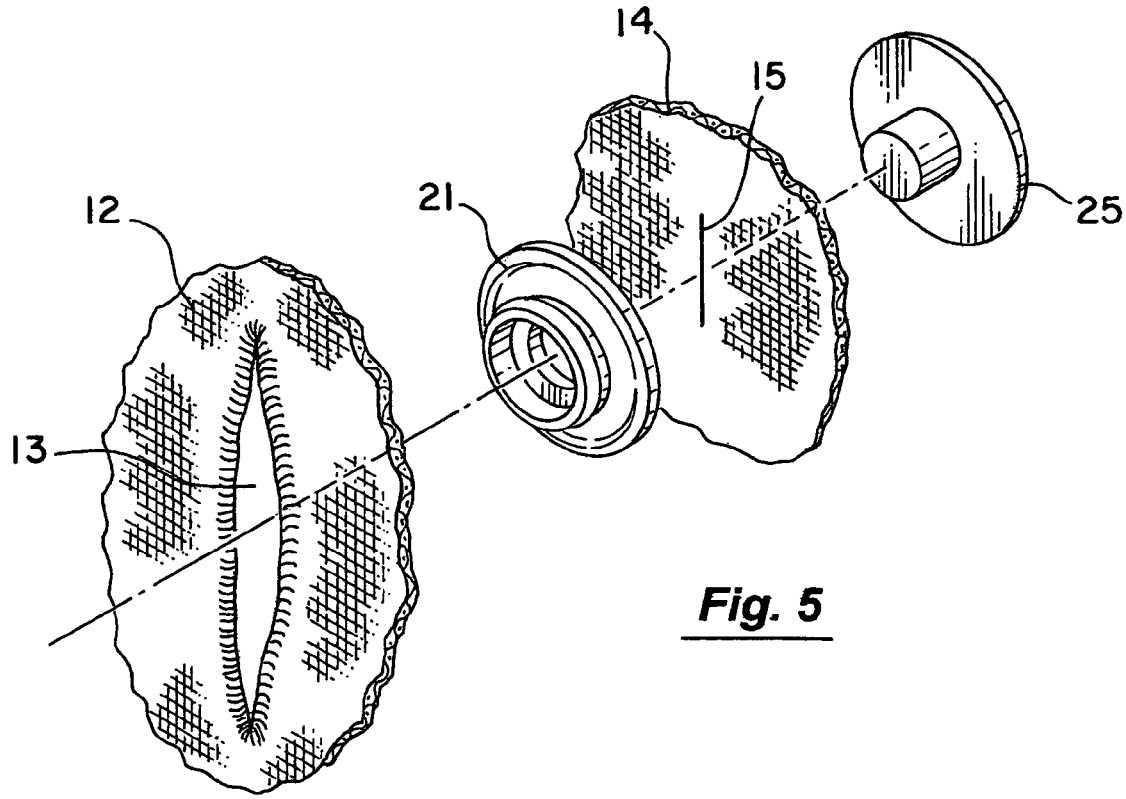
FIG. 5 is a detail exploded perspective view showing the assembly of the male snap fastener and the cuff of the sock.

FIGS. 4 and 5 are detail exploded perspective views showing the assembly of the snap fasteners 20 and 21 to the cuffs of the socks 10 and 11, respectively. In both cases, the snap fastener 20, 21 and its backing 25 are secured through a small hole 15 in the inner fabric layer 14 of the cuff. A second, larger slit or opening 13 in the outer fabric layer 12 allows the front of the snap fastener 20, 21 to be exposed through the outer fabric layer 12 of the cuff, so that the snap fastener can engage a complementary snap fastener on the other sock. Any of a wide variety of types of fasteners can be employed, including but not limited to metal or plastic snaps, or other types of clasps.

Prior to putting the socks 10, 11 on a wearer's feet, the wearer would typically disconnect the snap fasteners 20 and 21 from one another by exerting an axial force to pull the fasteners apart, as shown in FIG. 2. This allows the socks to be separated from one another. The slit 13 in the outer fabric layer 12 of the sock cuff will then tend to close over the snap fastener 20, 21 due to residual tension in the sock fabric. This effectively covers the snap fastener 20, 21 beneath the outer fabric layer 12 of the sock cuff so that it will not be visible to others.

After the socks have been worn and are ready for laundering, the wearer removes the socks and reconnects the snap fasteners 20, 21 to one another, as shown in the cross-sectional view provided in FIG. 3. The pair of connected socks can then be laundered and placed in storage as a unit. Depending on the size of the opening 13 in the outer fabric layer 12 of the sock cuff, it may be necessary to manually stretch or distend this opening to expose the snap fastener before it can be engaged to another fastener.

FIG. 6 is a perspective view of two socks 10, 11 in another embodiment of the present invention without a seam at the bottom of the cuff. A cross-sectional view of the upper portion of two socks with the snap fasteners 20 and 21 disconnected is shown in FIG. 7, and with the snap fasteners 20, 21 connected is shown in FIG. 8. This embodiment allows the sock cuff to be unrolled, if so desired by the wearer.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A pair of socks comprising:

a first sock having:

(a) a cuff with an inner fabric layer and an outer fabric layer folded over at least a portion of the inner fabric layer of the first sock;

(b) a first snap fastener secured to the inner fabric layer of the first sock; and (c) an opening extending through the outer fabric layer of the first sock to expose the first snap fastener; and a second sock having:

(a) a cuff with an inner fabric layer and an outer fabric layer folded over at least a portion of the inner fabric layer of the second sock;

a second snap fastener secured to the inner fabric layer of the second sock; and an opening extending through the outer fabric layer of the second sock to expose the second snap fastener;

said second snap fastener removably engaging the first snap fastener to removably secure the first sock to the second sock.

2. The pair of socks of claim 1 wherein the first snap fastener comprises a male snap fastener, and wherein the second snap fastener comprises a complementary female snap fastener.

3. The pair of socks of claim 1 wherein the opening in the first sock comprises a slit through the outer fabric layer that conceals the first snap fastener and can be stretched open to expose the first snap fastener.

4. The pair of socks of claim 1 further comprising a seam at the bottom of the cuff of the first sock securing the outer fabric layer to inner fabric layer.

5. The pair of socks of claim 1 wherein the first snap fastener further comprises a backing extending through the inner fabric layer of the first sock.

* * * * *